United States Patent [19]

Garvison

[11] Patent Number: 4,509,497

[45] Date of Patent: Apr. 9, 1985

[54] BOWSTRING RELEASE MECHANISM

[76] Inventor: Geary L. Garvison, 410 N. Shore Dr., South Haven, Mich. 49090

[21] Appl. No.: 209,757

[22] Filed: Nov. 24, 1980

[51] Int. Cl.[3] ..... F41C 19/00

[52] U.S. Cl. ..... 124/35 A

[58] Field of Search ..... 124/35 A, 24 R, 23 R, 124/41 A, 35 R, 31

[56] References Cited

U.S. PATENT DOCUMENTS

| | | | |
|---|---|---|---|
| 3,028,852 | 4/1962 | Sutton | 124/35 A |
| 3,072,115 | 1/1963 | Johnson | 124/35 A |
| 3,490,429 | 1/1970 | Benedict | 124/35 R |
| 3,757,763 | 11/1973 | Pinti | 124/35 |
| 3,898,974 | 8/1975 | Keck | 124/35 A |
| 3,929,120 | 12/1975 | Barner | 124/35 A |
| 3,954,095 | 5/1976 | Lewis | 124/35 A |
| 3,998,202 | 12/1976 | Boyko | 124/35 A |
| 4,009,703 | 3/1977 | Cunningham | 124/35 A |
| 4,022,181 | 5/1977 | Fletcher | 124/35 A |
| 4,030,473 | 6/1977 | Puryear | 124/35 R |

*Primary Examiner*—Steven A. Bratlie
*Assistant Examiner*—William R. Browne
*Attorney, Agent, or Firm*—Gordon W. Hueschen

[57] ABSTRACT

The disclosure concerns a release mechanism for drawing and releasing the bowstring of free-standing bows in which a triggered-latch mechanism is affixed to sheet of resilient, non-stretchable material shaped to overlie the palm of the archer's hand and to be strapped around his wrist. A thumbhold is provided in the sheet so that the triggered-latch mechanism can be drawn up into the crotch between the forefinger and the thumb and the trigger is positioned in the latch mechanism in position to be easily pulled by the forefinger when the triggered-latch mechanism is so positioned. The triggered-latch mechanism has a trigger and a rotary latch having a latching arm and a cocking arm and complementary detents on the trigger and the latch operative in the cocked position to prevent rotation of the latch, and in the release to permit rotation of the latch. The trigger and rotary latch are mounted in an elongate holding device having a bowstring receiving slot which cooperates with the latching arm and the cocking arm to cause the latching arm to latch onto the bowstring to permit drawing the bow and to effect release thereof when the trigger is actuated. The trigger has surfaces arranged to contact the rotary latch on opposite sides of the pivot point thereof to hold the rotary latch in position while the cocking arm is crosswise of the bowstring-receiving slot and in a position to effect rotation of the latch to the cocked position when the bowstring is inserted into the slot.

10 Claims, 8 Drawing Figures

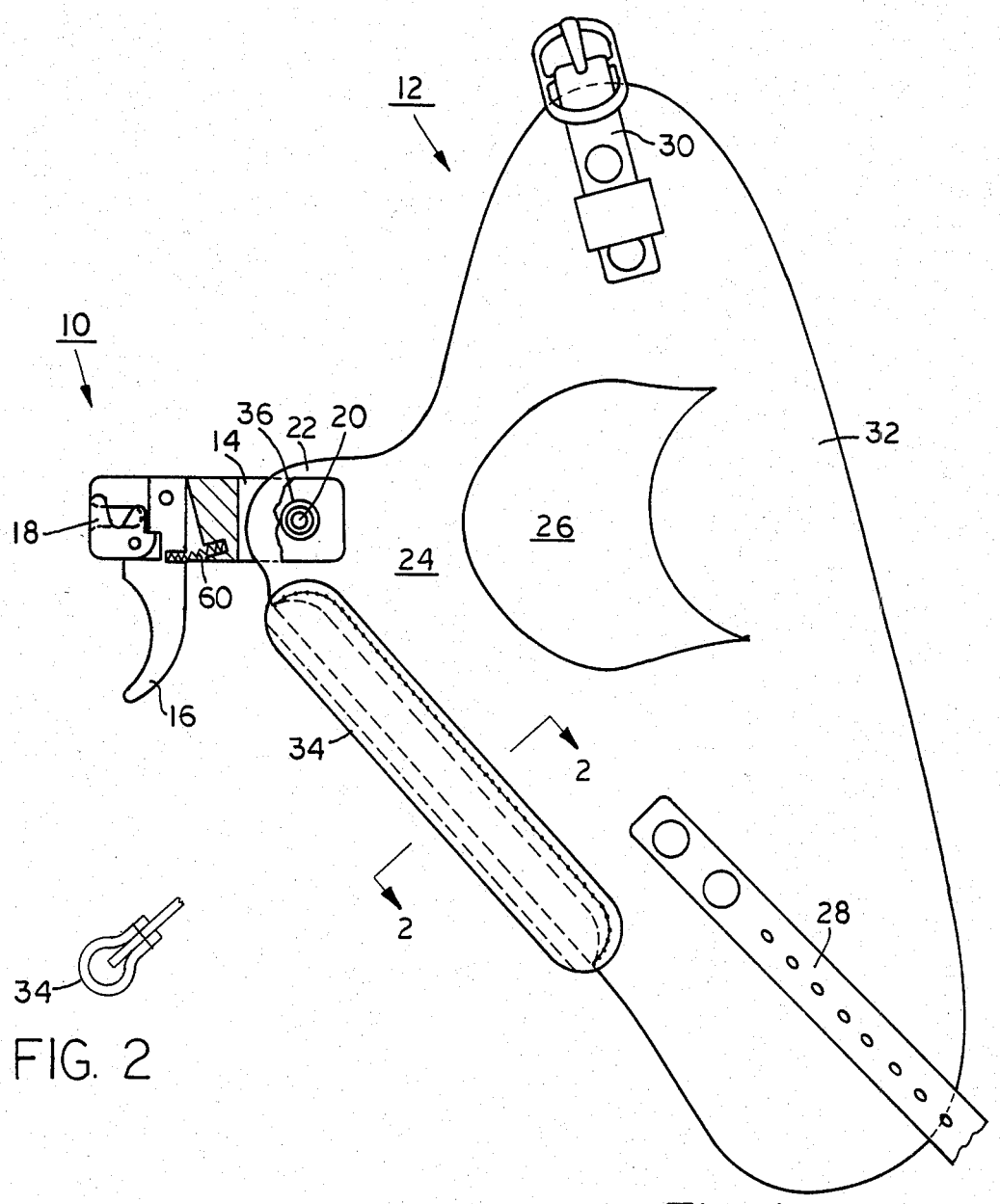
FIG. 2
FIG 1
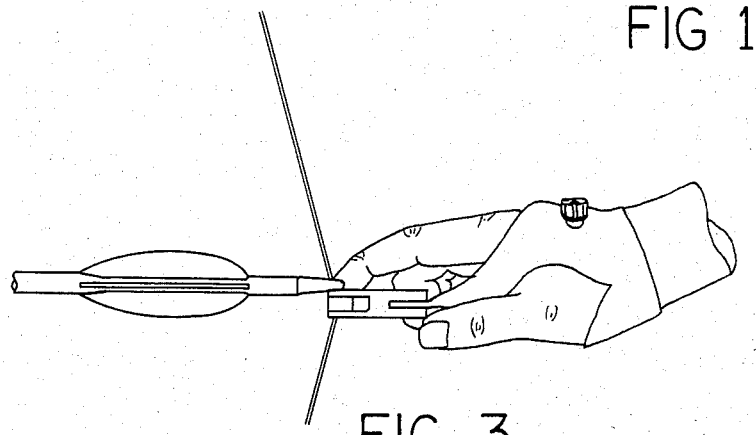
FIG. 3

BOWSTRING RELEASE MECHANISM

FIELD OF INVENTION AND PRIOR ART

The invention relates to an archery release mechanism for a free-standing bow.

Archery release mechanisms for crossbows are common. However, archery release mechanisms for free-standing bows are not; and those that are available suffer the disadvantage of complicating the draw of the bow and not being readily affixed to the bowstring.

OBJECTS OF THE INVENTION

It is an object of the invention to provide an improved archery release mechanism for free-standing bows. Another object of the invention is to provide an archery release mechanism for free-standing bows which is easily and quickly attachable to the bowstring. It is a further object of the invention to provide an archery release mechanism for free-standing bows which make it simple and easy to draw the bow and to release the arrow. Further objects of the invention are to avoid the disadvantages of the prior art and to obtain such advantages as will appear as the description proceeds.

BRIEF DESCRIPTION OF THE INVENTION

The invention relates to an archery release mechanism for a free-standing bow which comprises:

a sheet of resilient, non-stretchable material shaped to overlie the palm of an archer's hand;

a triggered-latch mechanism affixed to the sheet having latch means adapted releasably to engage the bowstring of the bow and trigger means adapted releasably to hold the latch means in latch position, whereby the bowstring is released when the trigger is pulled; and fastening means for fastening the sheet of material to the hand of the archer and holding the trigger means in a position relative to the trigger finger such that, when it is latched onto the bowstring and the bow, with a nocked arrow on the bowstring drawn to the desired release position, the trigger is still in position to be pulled by the trigger finger of the archer to effect release of the arrow.

Advantageously, the fastening means comprises wrist straps on opposite edges of the sheet of sufficient length to permit strapping the sheet to the wrist of the archer and to hold the sheet in position overlying the palm. It is of particular advantage if the fastening means also comprises finger-grasping means positioned to be grasped by at least one finger other than the trigger finger. In a preferred form, the finger-grasping means comprises an elongate rounded enlargement on one edge of the sheet angling back from the attachment of the triggered-latch mechanism thereto, which enlargement is of at least the width of three fingers long and is located in a position to be grasped by one or more fingers other than the trigger finger when the trigger finger is in position to pull the trigger.

Advantageously, the sheet of material which overlies the palm has a thumbhole therein between the straps, so that it can be pulled up tight around the wrist with the triggered-latch mechanism reposing in the crotch between the trigger finger and the thumb.

In a preferred form of the invention, the latch mechanism comprises cocking means which is actuated by the bowstring of the bow. Advantageously, the latch mechanism comprises a rotary member having a latching arm and a cocking arm and a fixed member having a bowstring-receiving slot in one end thereof, said rotary member being pivoted in said fixed member with, in the unlatched position, the cocking arm spanning the slot at an angle such that when the bowstring is moved into the slot, it engages the cocking arm and causes it to rotate the rotary member to a position in which the latching arm spans the slot and latches the bowstring whereby, when the bowstring is so latched in the slot, the bow can be drawn to the draw position and the bowstring released by a pull of the trigger.

In the broader aspects of the invention, the archery release mechanism can be utilized independently of means for strapping it to the wrist of the archer by simply providing it with grips to be held by the fingers of the archer with the trigger being actuated by one finger or the thumb of the archer. Such archery release mechanism comprises a trigger;

a rotary latch having a latching arm and a cocking arm;

complementary detents on the trigger and the latch operative in the cocked position to prevent rotation of the latch and, in the release position, to permit rotation of the latch; and elongate holding means for holding the trigger and the latch in operative position and, having in one end thereof, a longitudinal, bowstring-receiving slot which cooperates with the latching arm and the cocking arm to cause the latching arm to latch onto the bowstring to permit drawing the bow and to effect release thereof when the trigger is actuated.

Advantageously, the latch is mounted to rotate about a pivot point so located that the latching arm, in the cocked position, blocks the slot and acts to retain the bowstring in the slot until the trigger is actuated, whereupon it rotates to the release position and releases the bowstring, whereupon, the cocking arm is brought into cocking position in which a surface of the cocking arm extends diagonally upwardly and rearwardly across the slot where it functions as a cam surface or crank which is acted on by the bowstring entering the slot to cause the latch to be rotated to the cocked position.

Advantageously, there is provided limiting means for limiting the rotation of the rotary latch. This may be a fixed barrier positioned to be engaged by the cocking arm when the latch is rotated to the release position but, preferably, is a holding means for holding the rotary latch in the release position with the latching arm free of the slot so that the slot can be easily and quickly engaged on the bowstring and with the cocking arm in position to be engaged by the bowstring to move the latching arm back to the cocked position and to trap the bowstring in the slot. Advantageously, the holding means comprises surfaces on the trigger adapted to abut surfaces on the rotary latch, one of which is on one side of the pivot point and the other of which is on the other side of the pivot point.

In order to effect a self-cocking latch, the rotary latch can be provided with a curved cam surface sloping from the bottom of the latch to a point substantially opposite the pivot point up to the complementary detent thereon, effective on rotation of the latch to latching position to move the trigger and the complementary detent thereon to a position where one detent can be moved back past the other one into the latching position, the trigger being spring-biased against movement by the curved cam surface, whereby the trigger snaps back into latched position when the two detents are in latched position.

BRIEF DESCRIPTION OF THE DRAWINGS

In the drawings:

FIG. 1 is a plan view of the archery release mechanism of the invention with parts in section taken on line 1—1 of FIG. 7 to show details of the triggered-latch mechanism;

FIG. 2 is a section taken along line 2—2 of FIG. 1;

FIG. 3 is a side elevation illustrating the use of the archery release mechanism of FIG. 1;

DETAILED DESCRIPTION OF THE INVENTION

Figure 4:
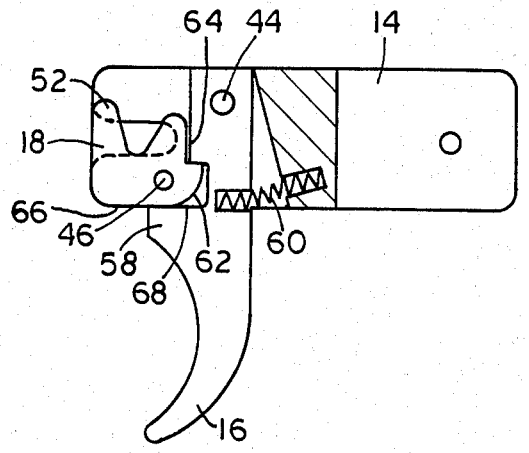
FIG. 4 is a detailed view of the triggered-latch mechanism of FIG. 1, showing the rotary latch in cocked position.

Referring now particularly to FIG. 1, there is illustrated an archery release mechanism of the invention which comprises a triggered-latch mechanism and a palm and wristband 12 for fastening the archery release mechanism 10 to the hand of the archer with the archery release mechanism in the crotch between the thumb and forefinger. Half of the casing or housing 14 has been removed to show the mounting of the trigger 16 and rotary latch 18, and the pin 20 which fastens the forward tongue 22 of the palm section 24 of the palm and wristband 12 to the triggered-latch mechanism 10.

The palm section 24 has a thumbhole 26 therein through which the thumb can be inserted to overlie the underside of the triggered-latch mechanism 10 and to allow the strap parts 28 and 30 to draw the wrist portion 32 about the wrist of the archer to securely fasten it there as a wristband.

The forward edge of the palm section slopes backward from the triggered-latch mechanism 10 and has an enlarged or thickened finger-gripping member 34 fastened thereto, as shown in greater detail in FIG. 2.

The palm and wristband 12 is made of leather or like pliable, non-stretchable material, and the finger-gripping enlargement 34 is fastened thereto by riveting or sewing and suitably comprises a split tube which is riveted or sewn to the palm section 24, as shown in FIGS. 1 and 2.

The tongue section 22 has a metallic grommet 36, the hole of which is slipped over the pin 20 to fasten the tongue section to the triggered-latch mechanism 10.

Figure 8:
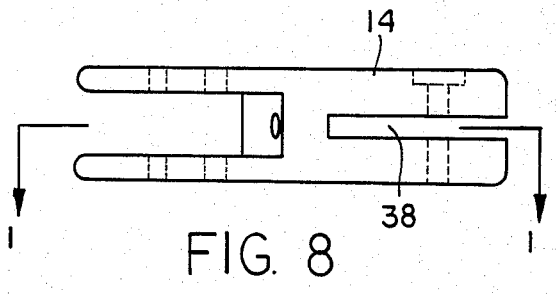
FIG. 8 is a side elevation of the casing or housing of the triggered-latch mechanism of FIG. 1.

For this purpose the housing or casing 14 is provided with a slot 38 just wide enough to receive the tongue section 22 and the grommet 36 and the pin 10 comprises a screw which is threaded into one side of the slot and has a head which is countersunk into the other side of the slot as best seen in FIG. 8.

In a preferred form of the invention, as will be more particularly described hereinafter, the release mechanism 10 is in the form of a narrow, elongate, box-shaped member having at one end attaching means (pin 20) for attaching it to a draw means (wrist band 12) and at the other end a bowstring-receiving slot 56.

FIG. 3 illustrates how the archery release mechanism abovedescribed is fastened to the wrist of the archer with the triggered-latch mechanism 10 disposed in the crotch of the thumb and forefinger and the forefinger extended to a position to engage the trigger 16. It is clearly seen from this figure that the narrow, elongate, box-shaped member is narrower than the trigger finger (forefinger) is thick and is shorter than it is long and is in position to be grasped by the thumb and forefinger for the purpose of latching it onto the bowstring. At the same time, the other three fingers are curled back around the finger-gripping enlargement 34, so that the triggered-latch mechanism 10 is firmly fixed in the crotch between the thumb and the forefinger.

The housing or casing 14 which, as above-noted, preferably is in the form of a narrow, elongate, box-shaped member has a longitudinal slot in the forward end adapted to receive the trigger 16 and the rotary latch mechanism 18, both of which are pivoted therein by suitable pivot pins, as shown at 44 and 46.

The trigger 16 and the rotary latch 18 have complementary detent surfaces 48 and 50 which, when engaged, as shown in FIG. 4, hold the latch 18 against rotation about its pivot point 46.

The rotary latch 18 has a latching arm 52 and a cocking arm 54. The housing 14 has a bowstring-receiving slot 56 in the forward end thereof in position to be completely intercepted or blocked by the latching arm 52 in the cocked position, as shown in FIG. 4.

Figure 5:
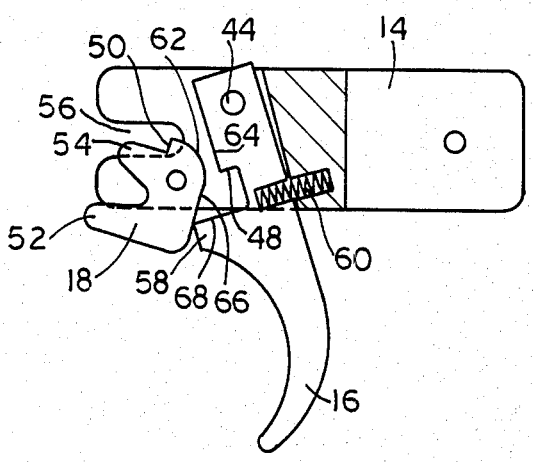
FIG. 5 is a detailed view of the triggered-release mechanism of FIG. 1, showing the rotary latch in full release position.

When the trigger 16 is pulled, the detent 48 moves back out of engagement with the detent 50 and allows the rotary latch 18 to rotate about its pivot 46 to a position shown in FIG. 5. The impetus for this rotation is the pull of the bowstring on the latching arm 52. Thus, as soon as the trigger is pulled, the bowstring causes the latch to spin or rotate forward and to release the bowstring.

Figure 6:
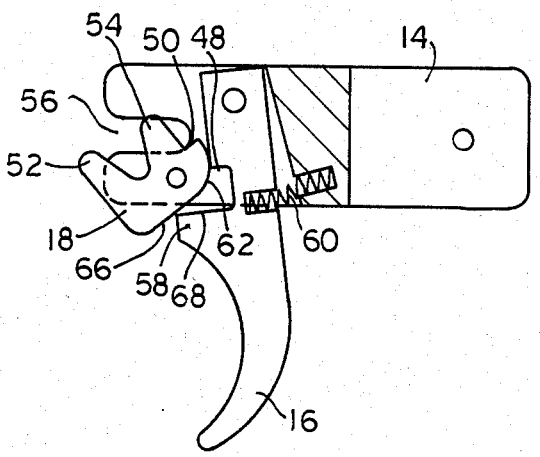
FIG. 6 is a detailed view of the triggered-release mechanism of FIG. 1, showing the rotary latch in pre-cocking position.
Figure 7:
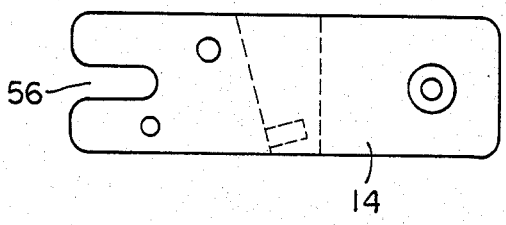
FIG. 7 is a side view of the casing or housing of the triggered-latch mechanism of FIG. 1.

The trigger 16 has a forward-projecting portion 58 adapted to engage a side of the rotary latch 18 and functions first, to stop rotation of the rotary latch as shown in FIG. 5, and second, to rotate the rotary latch back to the pre-cocked position shown in FIG. 6, in which position the cocking arm 54 is crosswise of the slot 56 in a position to be engaged by the bowstring. Thus, when the device is in the pre-cocked position shown in FIG. 6, it can be inserted on a bow-string, the bowstring acting on the cocking arm 54, causes the rotary latch 18 to rotate back to the point where the detents 48 and 50 engage. This engagement is made automatic by the spring-biasing of the trigger 16 by a suitable leaf spring, not shown, or by a coil spring, as shown at 60, and by a camming surface 62 on the rotary latch 18 which, as the rotary latch is rotated toward latching position, engages the forward surface 64 of trigger detent 48 and pushes the trigger back until the latch detent 50 is below or registers with the trigger detent 48, whereupon the trigger snaps back into latched position.

The rotary latch 18 has a flat surface 66 which is parallel to the flat detent surface 50 and on the opposite side of the latch pivot pin 46. The forward-projecting portion 58 has a flat surface 68 adapted to lie flat against the flat surface 66 of the rotary latch and forms with the trigger detent 48 a slot having a width substantially the same or a little wider than the distance between the flat surface 66 and the flat surface of the latch detent 50 so that, in the cocked position, the cammed surface 62 and the detent 50 fit snugly in the slot formed by the flat surface 68 and the detent 48, with the flat surface 66 in juxtaposition with the flat surface 68, as shown in FIG. 4.

The forward-projecting portion 58 extends forward just far enough so that it engages the flat surface 66 and stops rotation of the latch 18 beyond the point shown in FIG. 5, which is far enough to allow the latching arm to rotate freely away from the bowstring. Then, when the trigger is released, the portion 58 rotates the latch back into the position shown in FIG. 6, where the forward portion 64 of the trigger detent 48 engages the cam surface 62 on one side of the pivot pin 46, and the forward portion of the forward-projecting portion 58 engages the flat surface 66 on the other side of the pivot pin 46. This holds the rotary latch in a pre-cocked position in which the cocking arm 54 is crosswise of the slot 56 and in position to be engaged by the bowstring to cause rotation of the rotary latch 18 to the cocked position shown in FIG. 4.

The latching arm and the cocking arm form a "V", the point of which extends downwardly toward the flat surface 66 to a point forward of the pivot point 46 and about on a level with the projection of the detent 50. The forward portion of the cocking arm 54 has a flat, smooth surface which is engaged by the bowstring when it enters the slot in the position shown in FIG. 6 to cause rotation of the rotary latch 18 to the cocked position shown in FIG. 4.

In the broader aspects of the invention, other means can be provided to stop or arrest the rotation of the rotary latch 18. Thus, if the cocking arm 54 is long enough, it can engage a pin in the forward position of the housing and stop the rotation of the rotary latch 18. However, in the preferred modification shown, an advantage is obtained in that as soon as the latch detent is released, the bowstring flips the latching arm neatly and cleanly beyond any possible contact with the bowstring to the position shown in FIG. 5. Thereafter, release of the trigger causes the rotary latch to rotate back to the pre-cocked position shown in FIG. 6. Also, if desired, an adjustable stop, for example, a set screw acting on the top of the trigger above the pivot 44, can be provided to adjustably limit the forward motion of the trigger. In this way, the pull can be adjusted to whatever fineness is desired.

Thus, in the operation of the invention, the archery release mechanism is fastened to the wrist of the archer, the triggered-latch mechanism is latched on the bowstring to cock the rotary latch in the position shown in FIG. 1, whereupon an arrow is nocked, as shown in FIG. 3, and the bow drawn to release position, whereupon pulling of the trigger with the trigger finger releases the arrow in a smooth, unvarying release. Thus, greater accuracy is obtained than with the ordinary finger release which is susceptible to variation according to the skill of the archer.

It is to be understood that the invention is not to be limited to the exact details of operation or structure shown and described, as obvious modifications and equivalents will be apparent to one skilled in the art.

I claim:

1. A bowstring release mechanism which comprises:

a sheet of resilient, non-stretchable material shaped to overlie the palm of an archer's hand and having a thumbhole therein in combination with a triggered-latch mechanism affixed thereto;

said triggered-latch mechanism comprising an elongate rigid body in which the maximum dimension of any transverse cross section is substantially smaller than the length of said body;

latch means in one end of said elongate body adapted releasably to engage a bow-string;

trigger means operatively associated with said latch means and adapted releasably to hold said latch means in latch position, whereby a bowstring is released when said trigger means is actuated;

first fastening means for fastening said sheet of material to the wrist of the archer with the thumb projecting through said thumbhole; and, second fastening means for fastening said elongate body to said sheet at the end thereof opposite said latch means and in a position such that, when said latch means is latched onto a bowstring and drawn to the desired release position, the end of said elongate body which is fastened to said sheet is disposed in the crotch of the thumb and trigger finger; said elongate body being of such a length that when the end thereof which is attached to said sheet is so disposed in said crotch, it extends out to a position beyond and along side of the folded-back middle finger of the archer and along said trigger finger to a position where said trigger means can be actuated by said trigger finger to effect release of a bowstring and, when not latched, dangles down from said second fastening means in a position to be easily engaged by the thumb and forefinger for the purpose of latching it onto a bowstring.

2. A release mechanism according to claim 1, in which said first fastening means comprises strapping means for strapping said sheet to the wrist of said archer and finger-grasping means which is part of said sheet and cooperates with said strapping means to hold said sheet in the stated position overlying the palm where the trigger means can be grasped by and actuated by the trigger finger of the archer, said finger-grasping means being separated from said thumbhole by an expanse of said sheet sufficient to bring said finger-grasping means out into contact with the inner portion of said folded-back middle finger, whereby the stress induced on said sheet by drawing the bow is distributed between said first fastening means and said finger-grasping means.

3. An archery release mechanism according to claim 2, in which said finger-grasping means is long enough to be grasped by two or more fingers other than said trigger finger.

4. A bowstring release mechanism of a bow which comprises:

a sheet of resilient, non-stretchable material shaped to overlie the palm of an archer's hand;

a triggered-latch mechanism affixed to said sheet having latch means adapted releasably to engage a bowstring, and trigger means adapted releasably to hold said latch means in latch position, whereby said bowstring is released when said trigger is actuated;

fastening means for fastening said sheet of material to the hand of the archer and holding said trigger means in a position relative to said trigger finger such that, when it is latched onto a bowstring and drawn to the desired release position, a trigger means is in position to be actuated by the trigger finger of said archer to effect release of a bowstring; and finger-grasping means which comprises an elongate, rounded enlargement on one edge of said sheet angling back from the attachment of said triggered-latch mechanism thereto, said enlargement having a length of at least the width of three fingers and being located in a position relative to said fastening means to be grasped by one or more fingers other than the trigger finger when the trigger finger is in position to actuate said trigger.

5. A bowstring release mechanism of a bow which comprises:

a sheet of resilient, non-stretchable material shaped to overlie the palm of an archer's hand;

a triggered-latch mechanism affixed to said sheet having latch means adapted releasably to engage a bowstring, and trigger means adapted releasably to hold a latch means in latch position, whereby said bowstring is released when said trigger is actuated; and fastening means for fastening said sheet of material to the hand of the archer and holding said trigger means in a position relative to said trigger finger such that, when it is latched onto a bowstring and is drawn to the desired release position, said trigger means still is in position to be pulled by the trigger finger of said archer to effect release of a bowstring, in which a latch mechanism comprises cocking means actuated by said bowstring, and in which said first fastening means comprises wrist straps on opposite edges of said sheet of sufficient length to permit strapping said sheet to the wrist of said archer to hold said sheet in position overlying the palm and finger-grasping means comprising an elongate rounded enlargement on one edge of said sheet which angles back from the attachment of said triggered-latch mechanism thereto, has a length of at least the width of three fingers and is located in a position to be grasped by two or more fingers other than the trigger finger when the trigger finger is in position to actuate said trigger, and in which said sheet has a thumbhole therein between said straps.

6. In a bowstring release mechanism, the combination which comprises:

a trigger;

a rotary latch having an upstanding latching arm and an upstanding cocking arm forming a notch between them, said latch being mounted for rotation about a pivot disposed below said upstanding cocking arm;

complementary detents on said trigger and said latch operative in the cocked position to prevent rotation of said latch and, in the release position, to permit rotation of said latch; and an elongate rigid body which houses said trigger and said latch in operative position and having, in one end thereof, a longitudinal, bowstring-receiving slot which cooperates with said latching arm and said cocking arm to permit said latching arm to latch onto a bowstring of a bow to permit drawing a bow and to effect release thereof when the trigger is actuated, said elongate body being in the shape of a narrow, elongate, box-shaped member having at one end, attaching means for attaching it to draw means which is operative to draw said body and, in turn, said bow-string to drawn position and, at the other end, said bowstring-receiving slot, the distance from said attaching means to said slot being substantially longer than the width of any transverse cross section of said box-shaped member, and said trigger being pivoted in said box-shaped member above said slot but extending below said box-shaped member in position to be engaged by the index finger of the archer.

7. A bowstring release mechanism, the combination which comprises:

a trigger;

a rotary latch having a latching arm and a cocking arm;

complementary detents on said trigger and said latch operative in the cocked position to prevent rotation of said latch and, in the release position, to permit rotation of said latch; and elongate holding means for holding said trigger and said latch in operative position and having, in one end thereof, a longitudinal bowstring-receiving slot which cooperates with said latching arm and said cocking arm to permit said latching arm to latch onto a bowstring to permit drawing a bow and to effect release thereof when the trigger is actuated, in which said latch comprises and rotates about a pivot point so located that the latching arm, in the cocked position, blocks the slot and acts to retain a bowstring in said slot until the trigger is actuated, whereupon it rotates to the release position and re-releases said bowstring, which further comprises limiting means for limiting the rotation of said rotary latch, in which said limiting means comprises holding means for holding said rotary latch in a release position in which said latching arm is free of said slot so that said slot can be easily and quickly engaged on a bowstring and with said cocking arm in position to be engaged by a bowstring to move said latching arm to the cocked position and to trap the bowstring in said slot, and in which said holding means comprises spaced apart, line-contact edges on said trigger adapted to contact surfaces on said rotary latch in its release position, one of which is on one side of a pivot point and the other of which is on the other side of a pivot point.

8. An archery release mechanism of claim 7, in which said rotary latch has a curved cam surface sloping from the bottom of said latch to a point substantially opposite the pivot point up to the complementary detent thereon, effective on rotation of said latch to latching position to move said trigger and the complementary detent thereon to a position where one detent can be moved back past the other one into latching position, said trigger being spring-biased against movement by said curved cam surface, whereby the trigger snaps back into latched position when the two detents are in latching position.

9. A release mechanism of claim 6, which further comprises a wrist-strap draw means for fastening said elongate rigid body to the hand of the archer in a fixed position such that, when said elongate rigid body is latched onto said bowstring and a bowstring drawn to release position, the trigger finger of the archer will extend alongside said box-shaped member and the trigger will be held in a position to be actuated by the trigger finger of the archer.

10. A bowstring release mechanism which comprises:

a sheet of resilient, non-stretchable material shaped to wrap around the wrist of the archer, to overlie at least a part of the palm of an archer's hand, and to provide a finger-gripping portion at least wide enough to accommodate two or more fingers other than the index finger and the thumb;

a triggered-latch mechanism affixed to said sheet having latch means adapted releasably to engage a bowstring of a bow, and trigger means adapted releasably to hold said latch means in latch position, whereby an engaged bowstring is released when said trigger is actuated to release the same; and fastening means for fastening said sheet of material to the wrist of the archer for fastening said trigger means in a position relative to said index finger such that, when it is latched onto a bowstring and drawn to the desired release position, said trigger means is still in position to be actuated by the index finger of said archer to effect release of an engaged bowstring and said finger-gripping portion being spaced from said wrist-fastening means a distance such that it is in position to be engaged in the light formed when two or more fingers other than the index finger and the thumb are folded back on themselves and such that the tension of a drawn bow is distributed between said wrist-fastening means and said two or more fingers.

* * * * *

UNITED STATES PATENT AND TRADEMARK OFFICE

CERTIFICATE OF CORRECTION

PATENT NO. : 4,509,497

DATED : April 9, 1985

INVENTOR(S) : Geary L. Garvison

It is certified that error appears in the above-identified patent and that said Letters Patent is hereby corrected as shown below:

Col. 6, line 50; delete "other than" and insert -- in addition to --

Col. 6, line 52; delete "of a bow"

Col. 7, line 10; delete "of a bow"

Col. 10, line 4; insert a comma -- , -- after "bowstring"

Signed and Sealed this

*Twenty-ninth* Day of *October 1985*

[SEAL]

*Attest:*

DONALD J. QUIGG

*Attesting Officer*

*Commissioner of Patents and Trademarks—Designate*

UNITED STATES PATENT AND TRADEMARK OFFICE

CERTIFICATE OF CORRECTION

PATENT NO. : 4,509,497

DATED : April 9, 1985

INVENTOR(S) : Geary L. Garvison

It is certified that error appears in the above-identified patent and that said Letters Patent is hereby corrected as shown below:

Col. 10, line 6; "light" should read -- bight --

Signed and Sealed this

Seventh Day of September, 1993

Bruce Lehman

*Attest:*

BRUCE LEHMAN

*Attesting Officer*

*Commissioner of Patents and Trademarks*